US011439291B2

(12) United States Patent
Delin et al.

(10) Patent No.: US 11,439,291 B2
(45) Date of Patent: Sep. 13, 2022

(54) WASHING LIQUID DISTRIBUTION DEVICE FOR A DISHWASHER

(71) Applicant: ELECTROLUX APPLIANCES AKTIEBOLAG, Stockholm (SE)

(72) Inventors: Anna Delin, Stockholm (SE); Kristian Reunanen, Stockholm (SE)

(73) Assignee: Electrolux Appliances Aktiebolag

( * ) Notice: Subject to any disclaimer, the term of this patent is extended or adjusted under 35 U.S.C. 154(b) by 102 days.

(21) Appl. No.: 16/466,692

(22) PCT Filed: Dec. 20, 2016

(86) PCT No.: PCT/EP2016/081869
§ 371 (c)(1),
(2) Date: Jun. 5, 2019

(87) PCT Pub. No.: WO2018/113913
PCT Pub. Date: Jun. 28, 2018

(65) Prior Publication Data

US 2020/0060506 A1 Feb. 27, 2020

(51) Int. Cl.

| | |
|---|---|
| ***A47L 15/42*** | (2006.01) |
| ***A47L 15/23*** | (2006.01) |
| ***B05B 3/04*** | (2006.01) |

(52) U.S. Cl.
CPC ..... *A47L 15/23* (2013.01); *A47L 15/428* (2013.01); *B05B 3/0486* (2013.01)

(58) Field of Classification Search
CPC .... A47L 15/428; A47L 15/4282; A47L 15/23; B05B 3/0486; B05B 3/04; B05B 3/063
See application file for complete search history.

(56) References Cited

U.S. PATENT DOCUMENTS

| | | | | |
|---|---|---|---|---|
| 3,117,523 | A | 1/1964 | Jacobs | |
| 3,176,697 | A * | 4/1965 | Gibson | A47L 15/0089 134/183 |
| 3,189,283 | A * | 6/1965 | Moore | C02F 3/043 239/222.17 |
| 3,267,944 | A | 8/1966 | Meeker et al. | |
| 5,546,968 | A * | 8/1996 | Jeon | A47L 15/23 134/179 |

(Continued)

FOREIGN PATENT DOCUMENTS

| | | | |
|---|---|---|---|
| CN | 1210705 | A | 3/1999 |
| CN | 103 622 652 | A | 3/2014 |
| CN | 104706299 | A | 6/2015 |
| CN | 105286744 | A | 2/2016 |

(Continued)

OTHER PUBLICATIONS

KR20040023109—Machine Translation (Year: 2004).*

(Continued)

*Primary Examiner* — Marc Lorenzi
(74) *Attorney, Agent, or Firm* — RatnerPrestia

(57) ABSTRACT

A washing liquid distribution device may be provided that includes a holder and an impeller. The holder may hold the impeller within a washing chamber of a dishwasher. The impeller may include a disc-shaped body provided with a plurality of impeller blades extending from a surface of the disc-shaped body. The impeller blades may include driving blades being angled in a first direction to cause rotation of the impeller when washing liquid is directed onto the driving blades. The impeller blades may include at least one back-flow blade being angled in a second direction, where the second direction is opposite to the first direction. The present disclosure may also relate to a dishwasher including a washing liquid distribution device.

14 Claims, 2 Drawing Sheets

(56) References Cited

U.S. PATENT DOCUMENTS

| | | | | |
|---|---|---|---|---|
| 5,673,714 | A | 10/1997 | Campagnolo et al. | |
| 5,787,910 | A * | 8/1998 | Oda | A47L 17/00 134/102.2 |
| 9,839,944 | B2 | 12/2017 | Kim et al. | |
| 2005/0178414 | A1* | 8/2005 | Kang | A47L 15/23 134/176 |
| 2010/0116301 | A1 | 5/2010 | Heisele et al. | |
| 2015/0102127 | A1* | 4/2015 | Bentley | B05B 3/1021 239/222 |
| 2015/0128999 | A1 | 5/2015 | Park et al. | |

FOREIGN PATENT DOCUMENTS

| | | | | |
|---|---|---|---|---|
| DE | 1183214 | B * | 12/1964 | A47L 15/23 |
| EP | 0766945 | A2 * | 4/1997 | A47L 15/23 |
| EP | 1 232 720 | A2 | 8/2002 | |
| EP | 2679134 | A1 | 1/2014 | |
| KR | 20040023109 | A * | 3/2004 | |
| WO | WO 2014/102738 | A1 | 7/2014 | |

OTHER PUBLICATIONS

DE1183214—Machine Translation (Year: 1964).*
International Search Report and Written Opinion for Application No. PCT/EP2016/081869 dated Feb. 6, 2017, 9 pages.
Office Action for Brazilian Application No. BR112019012588 dated Jun. 8, 2020, 6 pages.
Chinese Office Action for Chinese Application No. 201680091753.5, dated Dec. 29, 2021, with translation, 22 pages.

* cited by examiner

WASHING LIQUID DISTRIBUTION DEVICE FOR A DISHWASHER

CROSS-REFERENCE TO RELATED APPLICATIONS

This application is a national stage application filed under 35 U.S.C. § 371 of International Application No. PCT/EP2016/081869 filed Dec. 20, 2016, which application is hereby incorporated by reference herein in its entirety.

TECHNICAL FIELD

The present invention relates to a washing liquid distribution device for a dishwasher, comprising a holder and an impeller, wherein the holder is configured to hold the impeller within a washing chamber of a dishwasher. The present invention further relates to dishwasher comprising a washing liquid distribution device.

BACKGROUND

A dishwasher is an apparatus for washing items by using a force of washing liquid directed onto the items by one or more washing liquid distribution devices. There are many requirements of today's dishwashers. Examples of such requirements are that a dishwasher is expected to wash items with a good cleaning result while environmental concerns require an efficient use of energy and washing liquid during a washing session. In addition, it is an advantage if the dishwasher is designed such that the sound emitted from the dishwasher is low during a washing session. Further, on the consumer market, it is an advantage if high quality products can be provided in a cost-efficient manner. In order to achieve a proper washing result, one important aspect is washing liquid distribution capability of washing liquid distribution devices of the dishwasher. In order to keep the sound level low during the wash session, it is an advantage if pressure of washing liquid from washing liquid distribution devices can be kept low. However, a too low pressure may result in a poor washing result. Accordingly, many of the requirements of today's dishwasher can be seen as conflicting requirements.

Traditionally, a dishwasher comprises a set of elongated wash arms rotatably arranged a washing chamber of the dishwasher. However, in order to meet some of the above-mentioned requirements, washing liquid distribution devices comprising impellers have been developed. Examples of washing liquid distribution devices comprising impellers are described in the document EP 1232720 A2 and the document US 2010116301 A1. Washing liquid distribution devices comprising impellers have several advantages over traditional wash arms. One such advantage is that the risk of stop of rotation is significantly reduced as compared to a traditional wash arm. Another advantage is that washing liquid distribution devices comprising impellers require less space than traditional wash arms. Therefore, such washing liquid distribution devices can be arranged vertically in the washing chamber and at positions in the washing chamber in which a traditional washing arm could not be fitted, or would be unsuitable.

However, in view of the prior art washing liquid distribution devices comprising impellers, there is room for improvement, especially regarding washing liquid distribution capability of the washing liquid distribution devices.

SUMMARY

It is an object of the present invention to provide a washing liquid distribution device with improved washing liquid distribution capability.

According to an aspect of the invention, the object is achieved by a washing liquid distribution device for a dishwasher, wherein the washing liquid distribution device comprises a holder and an impeller, wherein the holder is configured to hold the impeller within a washing chamber of a dishwasher. The impeller comprises a disc-shaped body provided with a plurality of impeller blades extending from a surface of the disc-shaped body. The impeller blades comprise driving blades being angled in a first direction in relation to a radial direction of the disc-shaped body of the impeller to cause rotation of the impeller when washing liquid is directed onto the driving blades. The impeller blades further comprise at least one backflow blade being angled in a second direction in relation to the radial direction of the disc-shaped body, where the second direction is opposite to the first direction.

Since the impeller blades comprise at least one backflow blade being angled in the second direction, washing liquid will be distributed differently from the backflow blade than from the driving blades being angled in a first direction with regard to distribution angle and distribution velocity from the impeller. Thereby, a more varying distribution pattern from the washing liquid distribution device is provided. As a result, washing liquid distribution capability is improved. Dishware arranged in a dishwasher comprising the washing liquid distribution device will be subjected to washing liquid from different angles and with different velocities, thus improving washing intensity, while a flowrate of washing liquid to the washing liquid distribution device can be kept low.

Further, due to these features, rotational velocity of the impeller may vary during one revolution of the impeller since the backflow blade is angled in the second direction being opposite to the first direction of the driving blades. As a result thereof, washing liquid distribution capability is further improved since washing liquid will be distributed differently from the impeller blades during rotation of the impeller with regard to distribution angle and distribution velocity from the impeller blades.

Accordingly, a washing liquid distribution device is provided with improved washing liquid distribution capability. As a result, the above mentioned object is achieved.

Further, since the washing liquid distribution capability is improved, a washing liquid distribution device is provided which more efficiently utilizes flow of washing liquid thereby providing conditions for a reduced consumption of energy and washing liquid for a dishwasher provided with the washing liquid distribution device.

Optionally, the impeller blades comprise at least one combined blade having a first portion being angled in the first direction and a second portion being angled in the second direction. Thereby, a jet of washing liquid, or a portion of a washing liquid flow, directed towards the combined blade may during rotation of the impeller first hit the second portion being angled in the second direction, to distribute washing liquid differently than when hitting other impeller blades, and then hit the first portion being angled in the first direction to contribute to rotation of the impeller. As a result, a washing liquid distribution device is provided with even further improved washing liquid distribution capability.

Optionally, the impeller blades comprise a first, a second and a third driving blade each having different average angles in relation to the radial direction of the disc-shaped body. Since the first, the second and the third blade driving blade each has different average angles in relation to the radial direction of the disc-shaped body, the respective driving blade will distribute washing liquid differently than the other driving blades regarding distribution angle and distribution velocity from the driving blades. Still, the first, the second and the third blade driving blade will contribute to rotation of the impeller, since they are angled in the first direction in relation to the radial direction of the disc-shaped body. As a result, a washing liquid distribution device is provided with even further improved washing liquid distribution capability. In addition, the different average angles in relation to the radial direction of the disc-shaped body of the first, the second and the third blade driving blade may contribute to a varying rotational velocity of the impeller which further may improve washing liquid distribution capability.

Optionally, the first driving blade is arranged prior to the second driving blade seen in an intended direction of rotation of the impeller, and wherein the first driving blade is provided with a greater average angle in relation to the radial direction r of the disc-shaped body than the second driving blade. As a result, the impeller will be subjected to a progress of acceleration when the first and second driving blades passes a jet of washing liquid, or a portion of a washing liquid flow. Thereby, a more varying velocity of the impeller is provided and distribution of washing liquid is further improved.

Optionally, the third driving blade is arranged after the second driving blade, seen in an intended direction of rotation of the impeller, and wherein the third driving blade is provided with a smaller average angle in relation to the radial direction of the disc-shaped body than the second driving blade. As a result, the impeller will be subjected to a progress of acceleration when the second and third driving blades passes a jet of washing liquid, or a portion of a washing liquid flow. Thereby, a more varying velocity of the impeller is provided and distribution of washing liquid is further improved.

Optionally, the impeller blades further comprise at least one rebound blade comprising a parabolic or cup-shaped portion essentially facing a centre of the impeller. Thereby, washing liquid hitting the parabolic or cup-shaped portion of the rebound blade may rebound towards the centre of the of the impeller, and/or may rebound a direction away from the surface, of the disc-shaped body from which the impeller blades extend. Further, the washing liquid may rebound through a through hole of the impeller to a side of the impeller opposite to the surface of the disc-shaped body from which the impeller blades extend. Thereby, the washing liquid distribution capability can be further improved. In addition, washing liquid being rebound towards the centre of the of the impeller may strike against washing liquid being directed in a direction towards the impeller blades. Thereby, an even more varying distribution pattern from the washing liquid distribution device can be provided which further improves washing liquid distribution capability.

Optionally, the impeller blades comprise at least one bi-convex blade having a bi-convex shape. A bi-convex shape is advantageous for directing washing liquid due to flow guiding characteristics of the bi-convex shape. The least one blade having a bi-convex shape may therefore direct washing liquid further into a washing chamber of the dishwasher than the other impeller blades and may distribute washing liquid differently regarding distribution velocity and distribution angle than the other impeller blades. Thereby, a more varying distribution pattern from the washing liquid distribution device is provided and the washing liquid distribution capability is further improved.

Optionally, the surface of the disc-shaped body, from which the plurality of impeller blades extend, is curve-shaped. Thereby, washing liquid directed onto the driving blades will be guided along the surface of the disc-shaped body, from which the plurality of impeller blades extend, and due to the curve shape be deflected. As a result, a washing liquid distribution device is provided with even further improved washing liquid distribution capability.

Optionally, the surface is convex. Thereby, washing liquid directed onto the driving blades will be guided along the convex surface of the disc-shaped body, from which the plurality of impeller blades extend, and as a result thereof be deflected into an area of a washing chamber being opposite to the surface of the disc-shaped body. As a result, a washing liquid distribution device is provided with even further improved washing liquid distribution capability.

Optionally, the impeller blades extend from the surface of the disc-shaped body between an inner radius and an outer radius of the disc-shaped body, wherein the holder is arranged to direct washing liquid onto the impeller blades at the inner radius. Thereby, an efficient distribution of washing liquid to the impeller blades is provided. Further, a compact washing liquid distribution device is provided.

Optionally, the holder comprises nozzles arranged to direct washing liquid onto the impeller blades. Thereby, a controlled and efficient distribution of washing liquid to the impeller blades is provided, which may require less flowrate of washing liquid to rotate the impeller since nozzles may provide a higher velocity of washing liquid than a solution without nozzles.

Optionally, the nozzles are arranged to direct washing liquid onto the impeller blades in directions having an angle in relation to radial directions of the disc-shaped body. Thereby, a washing liquid distribution device is provided with even further improved washing liquid distribution capability since washing liquid is hitting the impeller blades in directions having an angle in relation to radial directions of the disc-shaped body.

Optionally, the angle is a positive angle in relation to an intended direction of rotation of the impeller. Thereby, washing liquid will hit the respective impeller blade in an angle contributing to the rotation of the impeller. Thereby, rotational velocity of the impeller will increase while providing conditions for a reduced flowrate of wash liquid. Due to the increased rotational velocity of the impeller, a washing liquid distribution device is provided with even further improved washing liquid distribution capability. In addition, a washing liquid distribution device is provided more efficiently utilizing flow of washing liquid thereby providing conditions for a reduced consumption of energy and washing liquid.

It is a further object of the present invention to provide a dishwasher with improved washing liquid distribution inside a washing chamber of the dishwasher.

According to a further aspect of the invention, the further object is achieved by a dishwasher comprising a washing chamber and a washing liquid distribution device according to some embodiments, wherein the washing liquid distribution device is arranged to distribute washing liquid inside the washing chamber of the dishwasher. Since dishwasher comprises a washing liquid distribution device with improved washing liquid distribution capability being arranged to distribute washing liquid inside the washing chamber of the dishwasher, a dishwasher is provided with improved washing liquid distribution inside the washing chamber of the dishwasher.

As a result, the above mentioned further object is achieved.

Further features of, and advantages with, the present invention will become apparent when studying the appended claims and the following detailed description.

BRIEF DESCRIPTION OF THE DRAWINGS

Various aspects of the invention, including its particular features and advantages, will be readily understood from the example embodiments discussed in the following detailed description and the accompanying drawings, in which.

DETAILED DESCRIPTION

Aspects of the present invention will now be described more fully. Like numbers refer to like elements throughout. Well-known functions or constructions will not necessarily be described in detail for brevity and/or clarity.

Figure 1:
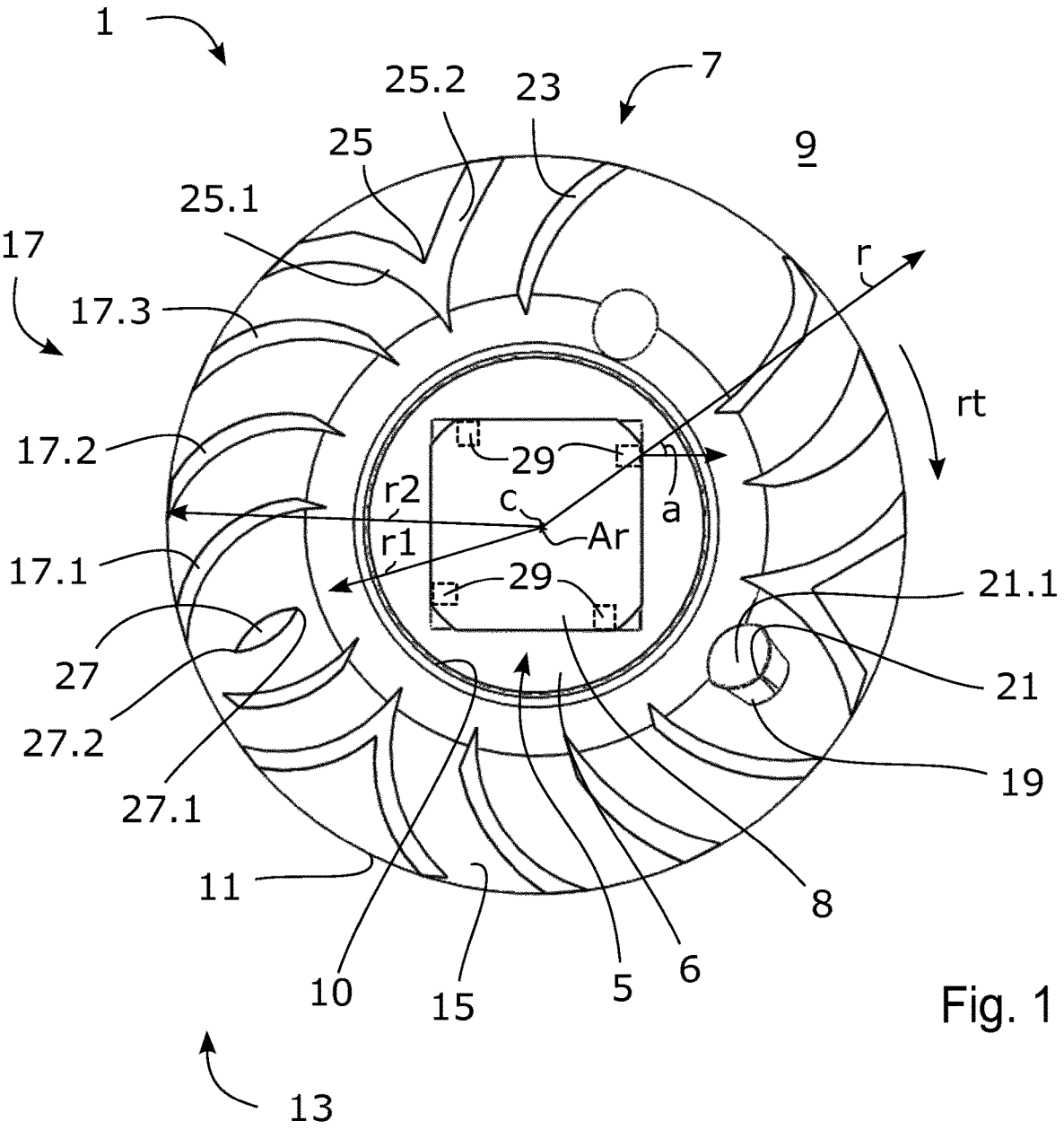
FIG. 1 illustrates a washing liquid distribution device for a dishwasher.

FIG. 1 illustrates a washing liquid distribution device 1 for a dishwasher 3. The washing liquid distribution device 1 comprises a holder 5 and an impeller 7. The holder 5 is configured to hold the impeller 7 within a washing chamber 9 of a dishwasher. The impeller 7 is rotatably arranged to the holder 5 around an axis of rotation Ar. The impeller 7 comprises a disc-shaped body 11 provided with a plurality of impeller blades 13 extending from a surface 15 of the disc-shaped body 11. The impeller blades 13 extends from the surface 15 in directions essentially coinciding with the axis of rotation Ar of the impeller 7. The impeller blades 13 comprise driving blades 17 being angled in a first direction in relation to a radial direction r of the disc-shaped body 11 of the impeller 7 to cause rotation of the impeller 7 when washing liquid is directed onto the driving blades 17. The washing liquid may comprise water, or a mixture of water, detergent and/or softener. The impeller blades 13 further comprise at least one backflow blade 23 being angled in a second direction in relation to the radial direction r of the disc-shaped body 11, where the second direction is opposite to the first direction. Thereby, washing liquid will be distributed differently from the backflow blade 23 than from the driving blades 17 being angled in the first direction with regard to distribution angle and distribution velocity from the impeller 7. Thereby, a more varying distribution pattern from the washing liquid distribution device 1 is provided. As a result, washing liquid distribution capability is improved. Further, rotational velocity of the impeller 7 may vary during one revolution of the impeller 7 since the backflow blade 23 is angled in the second direction being opposite to the first direction of the driving blades 17, and will thereby counteract rotation, instead of contributing to rotation, when washing liquid is directed onto the backflow blade 23. As a result thereof, washing liquid distribution capability is further improved.

According to the embodiments illustrated in FIG. 1, the holder 5 comprises a disc shaped supporting structure 6 with a supporting surface arranged to support the impeller 7 by abutting against a surface of the impeller 7. The holder 5 further comprises a body portion 8. The body portion 8 comprises a washing liquid inlet and fastening elements for fasting the washing liquid inlet a washing liquid duct of a dishwasher. The body portion 8 comprises an inner volume fluidically connected to the washing liquid inlet. The disc-shaped body 11 of the impeller 7 comprises a through hole 10 in a centre c of the disc-shaped body 11. The body portion 8 of the holder 5 is arranged to extend through the through hole 10. The body portion 8 comprises nozzles 29 configured to direct washing liquid from the inner volume of the body portion 8 onto the impeller blades 13 to rotate the impeller 7. The embodiments of the holder 5 are example embodiments, and the washing liquid distribution device 1 may comprise other types of holders for holding the impeller 7 within a washing chamber 9 of a dishwasher. Further, the impeller 7 may necessarily not comprise the through hole 10 in the centre c of the disc-shaped body 11. Instead, the impeller 7 may comprise a conical centre section configured to distribute washing liquid to the impeller blades 13 by guiding washing liquid from a jet of washing liquid directed towards the conical centre section in a direction essentially coinciding with the axis of rotation Ar of the impeller 7. In such embodiments, the holder may lack nozzles for directing washing liquid towards the impeller blades 13.

In the embodiments illustrated in FIG. 1, the impeller blades 13 comprise a combined blade 25 having a first portion 25.1 being angled in the first direction and a second portion 25.2 being angled in the second direction. Thereby, a jet of washing liquid, or a portion of a washing liquid flow, directed towards the combined blade 25 may, during rotation of the impeller 7, first hit the second portion 25.2 being angled in the second direction to distribute washing liquid differently than when hitting other impeller blades 13, and then hit the first portion 25.1 being angled in the first direction to contribute to rotation of the impeller 7. As a result, a washing liquid distribution device 1 is provided with even further improved washing liquid distribution capability.

The impeller blades 13 may comprise two or more backflow blades 23 and two or more second portions 25.2 being angled in a second direction in relation to the radial direction r of the disc-shaped body 11. In the illustrated example embodiments, the impeller blades 13 comprises two back flow blades and three second portions being angled in a second direction in relation to the radial direction r of the disc-shaped body 11. Thereby, an efficient distribution of washing liquid is provided.

Further, according to the embodiments of the washing liquid distribution device 1 illustrated in FIG. 1, the impeller blades 13 comprise a first, a second and a third driving blade 17.1, 17.2, 17.3 each having different average angles in relation to the radial direction r of the disc-shaped body 11. Thereby, the respective driving blade 17.1, 17.2, 17.3 will distribute washing liquid differently than the other driving blades 17.1, 17.2, 17.3 regarding distribution angle and distribution velocity from the driving blades 17.1, 17.2, 17.3. In addition, the different average angles in relation to the radial direction r of the disc-shaped body 11 of the first, the second and the third driving blade 17.1, 17.2, 17.3 may contribute to a varying rotational velocity of the impeller 7 which further may improve the distribution of washing liquid. In the illustrated embodiments, the first, the second, and the third driving blades 17.1, 17.2, 17.3 are arranged adjacent to each other at the disc-shaped body 11 of the impeller 7 which may further contribute the varying rotational velocity of the impeller 7 and thus further improve the distribution of washing liquid.

Further, in the illustrated embodiments, the first driving blade 17.1 is arranged prior to the second driving blade 17.2, seen in an intended direction of rotation rt of the impeller 7, and the first driving blade 17.1 is provided with a greater average angle in relation to the radial direction r of the disc-shaped body 11 than the second driving blade 17.2. Further the third driving blade 17.3 is arranged after the second driving blade 17.2, seen in an intended direction of rotation rt of the impeller 7, and wherein the third driving blade 17.3 is provided with a smaller average angle in relation to the radial direction r of the disc-shaped body 11 than the second driving blade 17.2. Due to these features, during rotation of the impeller 7, a jet of washing liquid, or a portion of a washing liquid flow, will first hit the third driving blade 17.3 provided with a relatively small average angle in relation to the radial direction r of the disc-shaped body 11. Then, the jet of washing liquid, or the portion of the washing liquid flow, will hit the second driving blade 17.2 provided with a greater angle in relation to the radial direction r of the disc-shaped body 11 than the third driving blade 17.3. Due to the greater angle, the hitting of washing liquid onto the second driving blade 17.2 will contribute more to rotation of the impeller 7 than hitting of washing liquid onto the third driving blade 17.3. After hitting the second driving blade 17.2, the jet of washing liquid, or the portion of the washing liquid flow, will hit the first driving blade 17.1 provided with a greater angle in relation to the radial direction r of the disc-shaped body 11 than the second driving blade 17.2. Due to the greater angle, the hitting of washing liquid onto the first driving blade 17.1 will contribute more to rotation of the impeller 7 than hitting of washing liquid onto the third driving blade 17.3. Accordingly, due to these features, the impeller 7 will be subjected to a progress of acceleration when the first, second and third driving blades 17.1, 17.2, 17.3 passes a jet of washing liquid, or a portion of a washing liquid flow. As a result, a more varying velocity of the impeller 7 is provided which results in a further improved distribution of washing liquid.

The average angle in relation to the radial direction r of the disc-shaped body 11 may be defined as the average angle along an active portion of an impeller blade 13, wherein the active portion of the impeller blade 13 is a portion of the blade being arranged to guide washing liquid. The average angle in relation to the radial direction r of the disc-shaped body 11 may further be defined as the average angle of an infinite number of angles measured along the active portion of the impeller blade 13. The feature that an impeller blade 27 is angled in a direction in relation to the radial direction r of the disc-shaped body 25, may also be expressed as that the impeller blade 27 is angled in a direction towards the radial direction r of the disc-shaped body 25.

Further, in the illustrated embodiments, the impeller blades 13 comprise at least one bi-convex blade 27 having a bi-convex shape. The blade 27 having a bi-convex shape has two active surfaces each being convex. The two active surfaces connect a first pointed end face 27.1 and a second pointed end face 27.2. A direction of a line drawn between the first and second pointed end faces 27.1, 27.2 may be referred to as a main extension of the bi-convex bade 27. The main extension of the bi-convex blade 27 may be arranged in the radial direction r of the radial direction r of the disc-shaped body 11, or with a slight angle in relation to the radial direction r of the disc-shaped body 11, as is illustrated in FIG. 1. Thereby, washing liquid will be guided along both convex surfaces of the bi-convex blade 27 and washing liquid will meet at the second pointed end face 27.2. As a result, the bi-convex blade 27 will direct washing liquid further into a washing chamber of the dishwasher than the other impeller blades and will distribute washing liquid differently regarding distribution velocity and distribution angle than the other impeller blades. Thus, a more varying distribution pattern of washing liquid is provided. As a result, distribution of washing liquid into the washing chamber 9 is further improved.

Further, in the illustrated embodiments, the impeller blades 13 further comprise at least one rebound blade 19 comprising a parabolic or cup-shaped portion 21 essentially facing a centre c of the impeller 7. Thereby, washing liquid hitting the parabolic or cup-shaped portion 21 of the rebound blade 19 may rebound towards the centre of the of the impeller. The washing liquid being rebound towards the centre c of the of the impeller may strike against washing liquid being directed in a direction towards the impeller blades 13. Thereby, an even more varying distribution pattern from the washing liquid distribution device 1 can be provided which further improves washing liquid distribution capability.

Further, washing liquid hitting the parabolic or cup-shaped portion 21 of the rebound blade 19 may rebound in a direction away from the surface 15 of the disc-shaped body 11, i.e. upwards in FIG. 1. This since the surface 15 of the disc-shaped body adjoins the parabolic or cup-shaped portion 21 which hinders washing liquid from going through the surface 15 and directs the washing liquid in a direction away from the surface 15. To further increase this effect, the surface 15 may be provided with a bowl-shaped depression 21.1 adjacent to the rebound blade 19. According to the embodiments illustrated in FIG. 1, a surface normal of the surface 15 points in a direction into the washing chamber 9. Due to the rebound blade 19 comprising a parabolic or cup-shaped portion 21, distribution of washing liquid from the washing liquid distribution device 1 into the washing chamber 9 is further improved.

According to the illustrated embodiments, the impeller blades 13 extend from the surface 15 of the disc-shaped body 11 between an inner radius r1 and an outer radius r2 of the disc-shaped body 11, wherein the holder 5 is arranged to direct washing liquid onto the impeller blades 13 at the inner radius r1.

The surface 15 of the disc-shaped body 11, from which the plurality of impeller blades 13 extends, may be curve-shaped. According to some embodiments, the surface 15 is convex. Thereby, when washing liquid is directed onto the impeller blades 13 along the surface 15, washing liquid will be directed towards portions of the washing chamber 9 opposite to a surface normal of the surface 15. Thereby, distribution of washing liquid into such portions can be further improved.

According to the illustrated embodiments, the holder 5 comprises nozzles 29 arranged to direct washing liquid onto the impeller blades 13. The nozzles 29 may be arranged to direct washing liquid onto the impeller blades 13 in essentially radial directions of the disc-shaped body 11. According to the illustrated embodiments, the nozzles 29 are arranged to direct washing liquid onto the impeller blades 13 in directions having an angle a in relation to radial directions of the disc-shaped body 11. The angle a is a positive angle a in relation to an intended direction of rotation of the impeller 7. Thereby, washing liquid directed from the nozzles 29 will hit the impeller blades 13 in angles contributing to the rotation of the impeller 7. Due to these features, rotational velocity of the impeller 7 is increased while conditions are provided for a reduced flowrate of wash liquid directed onto the impeller blades 13.

Figure 2:
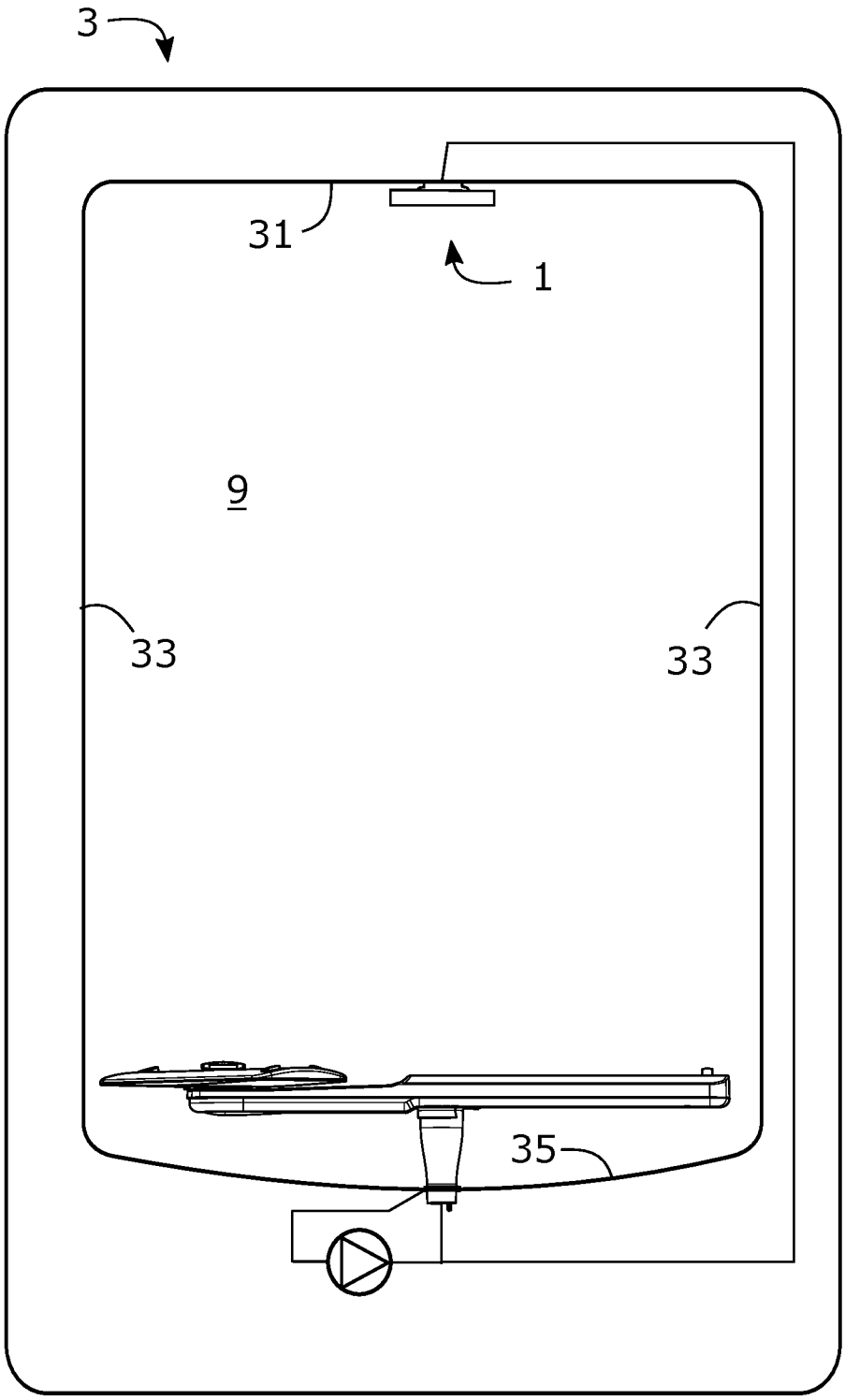
FIG. 2 illustrates a dishwasher comprising a washing chamber and a washing liquid distribution device, according to some embodiments.

FIG. 2 illustrates a dishwasher 3 comprising a washing chamber 9 and a washing liquid distribution device 1, according to some embodiments. The washing liquid distribution device 1 is arranged to distribute washing liquid inside the washing chamber 9 of the dishwasher 3. The dishwasher 3 illustrated in FIG. 2 comprises a washing liquid distribution device 1 arranged at an upper inner wall 31 of the washing chamber 9. However, the dishwasher 9 may comprise a washing liquid distribution device 1 at another position in the washing chamber 9, such as at side walls 33 or in a lower portion 35 of the washing chamber 9. In addition, the dishwasher 3 may comprise two or more washing liquid distribution devices 1 arranged at different positions within the washing chamber 9. The surface of the disc-shaped body from which the impeller blades extends may face the washing chamber 9 or may face a wall of the washing chamber 9.

The washing chamber 9 is configured to accommodate racks for holding items to be washed within the washing chamber 9. For clarity reasons, such racks and items to be washed are not illustrated in FIG. 2. Likewise, the dishwasher 3 comprises a dishwasher door pivotally arranged at the dishwasher 3 to allow access to the washing chamber 9 and to provide a closing surface of the washing chamber 9. The dishwasher door is not illustrated in FIG. 1 for clarity reasons.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A washing liquid distribution device for a dishwasher, wherein the washing liquid distribution device comprises:

a holder; and an impeller, wherein the holder is configured to hold the impeller within a washing chamber of a dishwasher, wherein the impeller comprises a disc-shaped body provided with a plurality of impeller blades extending from a surface of the disc-shaped body, wherein the impeller blades comprise:

driving blades being angled in a first circumferential direction in relation to a radial direction of the disc-shaped body of the impeller to have a first concave portion facing the first circumferential direction to cause rotation of the impeller in a rotational direction when washing liquid is directed onto the first concave portion of the driving blades, wherein the impeller blades further comprise at least one backflow blade being angled in a second circumferential direction in relation to the radial direction of the disc-shaped body of the impeller to have a second concave portion facing the second circumferential direction to counteract the rotation of the impeller in the rotational direction when washing liquid is directed onto the second concave portion of the backflow blades, where the second circumferential direction is opposite to the first circumferential direction, wherein the holder comprises a nozzle arranged to direct a stream of washing liquid onto the impeller blades, wherein the stream of washing liquid exits the nozzle in a direction from an inner radius of the disc-shaped body to an outer radius of the disc-shaped body.

2. The device according to claim 1, wherein the impeller blades further comprise at least one combined blade having a first portion being angled in the first circumferential direction and a second portion being angled in the second circumferential direction.

3. The device according to claim 1, wherein the driving blades comprise a first, a second and a third driving blade each having different average angles in the first circumferential direction.

4. The device according to claim 3, wherein the first, the second, and the third driving blades are arranged adjacent to each other at the disc-shaped body of the impeller.

5. The device according to claim 3, wherein the first driving blade is arranged prior to the second driving blade, seen in an intended direction of rotation of the impeller, and wherein the first driving blade is provided with a greater average angle in relation to the radial direction of the disc-shaped body than the second driving blade.

6. The device according to claim 3, wherein the third driving blade is arranged after the second driving blade, seen in an intended direction of rotation of the impeller, and wherein the third driving blade is provided with a smaller average angle in relation to the radial direction of the disc-shaped body than the second driving blade.

7. The device according to claim 1, wherein the impeller blades further comprise at least one rebound blade comprising a parabolic or cup-shaped portion facing a center of the impeller.

8. The device according to claim 1, wherein the impeller blades comprise at least one bi-convex blade having a bi-convex shape.

9. The device according to claim 1, wherein the surface of the disc shaped body, from which the plurality of impeller blades extends, is curve-shaped.

10. The device according to claim 9, wherein the surface is convex.

11. The device according to claim 1, wherein the impeller blades extend from the surface of the disc-shaped body between an inner radius and an outer radius of the disc-shaped body, wherein the holder is arranged to direct washing liquid onto the impeller blades at the inner radius.

12. The device according to claim 1, wherein the nozzle is arranged to direct washing liquid onto the impeller blades in the direction having an angle in relation to the radial direction of the disc-shaped body.

13. The device according to claim 12, wherein the angle is a positive angle in relation to an intended direction of rotation of the impeller.

14. A dishwasher comprising a washing chamber and the washing liquid distribution device according to claim 1, wherein the washing liquid distribution device is arranged to distribute washing liquid inside the washing chamber of the dishwasher.

* * * * *